United States Patent [19]

Küpper

[11] Patent Number: 4,508,227

[45] Date of Patent: Apr. 2, 1985

[54] COP PREPARATION PLANT

[75] Inventor: Wilhelm Küpper, Wegberg, Fed. Rep. of Germany

[73] Assignee: W. Schlafhorst & Co., Monchen-Gladbach, Fed. Rep. of Germany

[21] Appl. No.: 587,861

[22] Filed: Mar. 12, 1984

Related U.S. Application Data

[63] Continuation of Ser. No. 327,040, Dec. 3, 1981.

[30] Foreign Application Priority Data

Dec. 5, 1980 [DE] Fed. Rep. of Germany ..... 3045825

[51] Int. Cl.[3] ..... B07C 5/00; B26D 7/06; B26D 5/28; B65H 59/00

[52] U.S. Cl. ..... 209/927; 83/79; 83/371; 242/35.6 R

[58] Field of Search ..... 209/927; 242/35.6 R; 83/79, 80, 100, 367, 370, 371

[56] References Cited

U.S. PATENT DOCUMENTS

| | | | |
|---|---|---|---|
| 3,017,129 | 1/1962 | Trost | 242/35.6 R |
| 3,023,974 | 3/1962 | Furst | 242/35.6 R |
| 3,026,054 | 3/1962 | Schweiter | 242/35.6 R |
| 3,195,298 | 7/1965 | Furst | 209/927 |
| 3,203,634 | 8/1965 | Furst | 242/35.6 R |
| 3,207,307 | 9/1965 | Means | 209/927 |
| 3,210,022 | 10/1965 | Perry | 242/35.6 R |
| 4,181,228 | 1/1980 | Hashimoto et al. | 209/927 |
| 4,353,467 | 10/1981 | Harzenmoser | 209/927 |

*Primary Examiner*—Paul A. Bell

*Attorney, Agent, or Firm*—Herbert L. Lerner; Laurence A. Greenberg

[57] ABSTRACT

Cop preparation plant, including a device for locating, drawing off and cutting to length thread ends of a spinning cop, a device disposed down stream of the locating, drawing off and cutting device in travel direction of the cops, for separating spinning cops having thread ends of a substandard length from other spinning cops, and a device disposed down stream of the separating device for retracting the separated cops into another cop separating device connected in series with the cop preparation plant.

7 Claims, 1 Drawing Figure

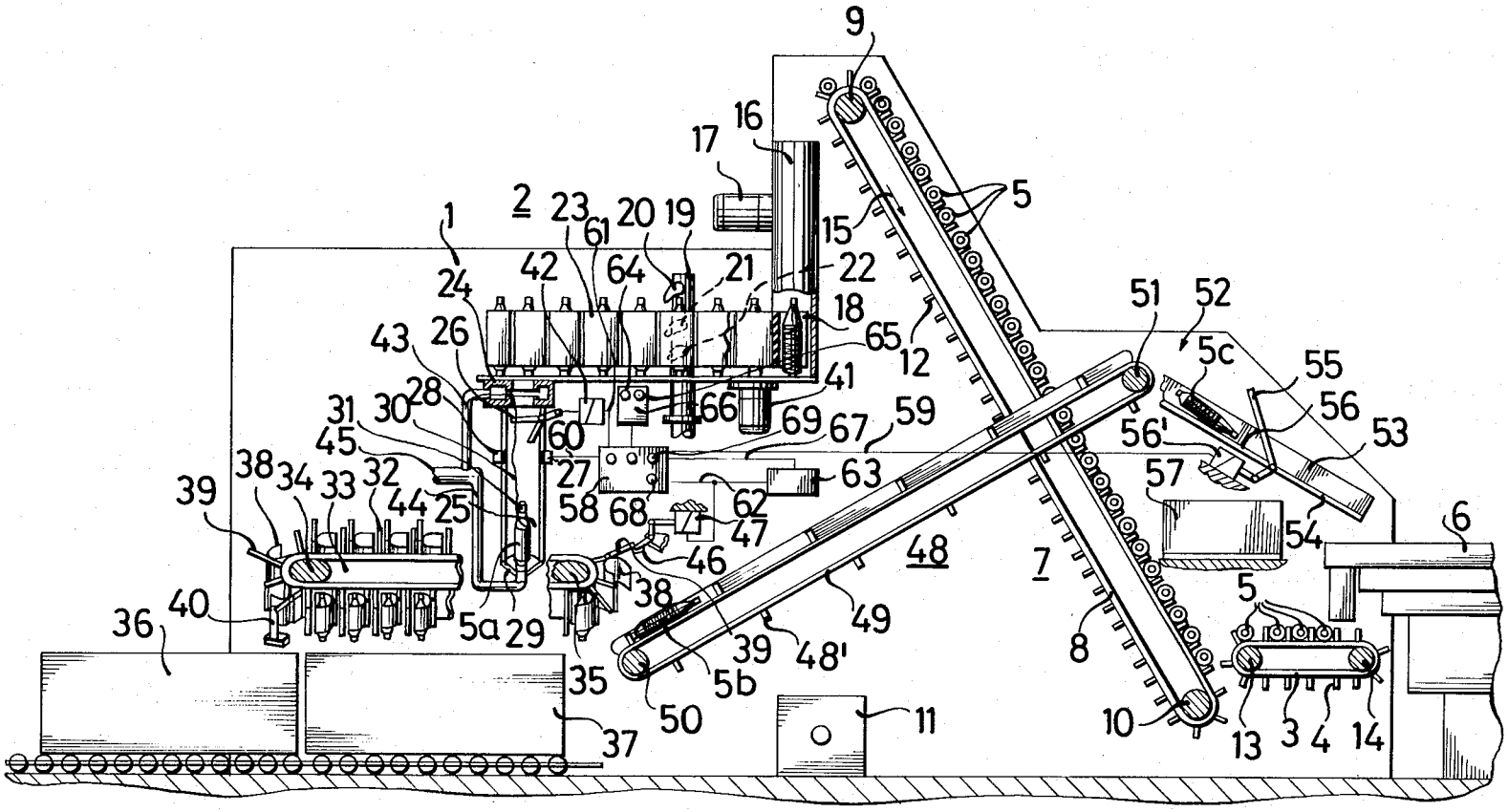
1
2
3
4
5
5a
5b
5c
6
7
8
9
10
11
12
13
14
15
16
17
18
19
20
21
22
23
24
25
26
27
28
29
30
31
32
33
34
35
36
37
38
39
40
41
42
43
44
45
46
47
48
48'
49
50
51
52
53
54
55
56
56'
57
58
59
60
61
62
63
64
65
66
67
68
69

COP PREPARATION PLANT

This application is a continuation of application Ser. No. 327,040, filed Dec. 3, 1981.

The invention relates to a cop preparation plant or machine unit having a device for locating, doffing or drawing off, and cutting to length the tip or end of the thread of a spinning cop, and a device for separating those spinning cops, in which the thread end does not have a preset length.

Cop preparation plants such as these are used, for example, for supplying a winding machine with creel bobbins having a thread end which is ready for rewinding.

Customarily, those separated spinning cops, in which either the thread end could not be located or has no preset length, are deposited in a container. Subsequently, the separated cops are manually prepared for unwinding, which is an extremely time-consuming process.

It is accordingly an object of the invention to provide a cop preparation plant which overcomes the hereinafore-mentioned disadvantages of the heretofore-known devices of this general type, and to raise the effectiveness of the cop preparation plant and especially to reduce the extent of manual labor required from the monitoring personnel.

With the foregoing and other objects in view there is provided, in accordance with the invention, a cop preparation plant, comprising a device for locating, drawing off and cutting to length thread ends of a spinning cop, a device disposed down stream of the locating, drawing off and cutting device in travel direction of the cops, for separating spinnng cops having thread ends of a substandard length, i.e. which do not have a preset given length, from other spinning cops, and a device disposed down stream of the separating device for retracting the separated cops into another cop separating device connected in series with the cop preparation plant.

Accordingly, the cops which have been separated and require special preparation are retracted to a cop separating device, from which the cop preparation plant is constantly supplied with cops. At this stage the tracted cops at first are still mixed with other cops to be separated. They are threfore still moved around, rotated, turned over, and constantly placed in contact with adjacent cops, so that there is enough of a chance for automatically detaching the thread end from the coil surface. Upon a second pass through the cop preparation plant, as a rule the thread end is picked up and out down to the preset length.

However, in cases where the thread end still cannot be found under poor storage conditions, the cops would be re-separated and retracted.

Though it would not be of great consequence if one and the same cop were constantly cycled without any preparation, the breakdown potential involved only becomes acute with the increasing amount of circulated cops. The warning sign is an increase in the rate of separated cops, i.e. in the amount thereof per unit time. Up to a certain degre, even this increased rate of separated cops is tolerable, without taking appropriate measures. In some cases the individual cop batches are not great enough as to noticeably reduce the effectiveness of the cop preparation plant during the run-through of the total load.

However, if processing of the same batches for hours or even for days is carried out in a cop preparation plant, then requirements call for interrupting the useless circulation of some or a plurality of cops being separated repeatedly again and again. For this purpose, in accordance with another fature of the invention, there is provided a cop storage bin, a branch leading from the retracting device to the cop storage bin, and a switchable deflector for selectively deflecting cops to the branch. The result is that any separated cops, such as over a specified period, can be fed to a cop storage bin instead of the series-connected cop separating device. If this is continued for as long as is required by a cop for travelling from the cop separating device through the cop preparation plant, then all cops which up to this point have been constantly circulating and do not require any more preparatory work, are safely separated. Subsequently the deflector can be reset. The cops left at this point in the cop storage bin either are unusable in effect because of the simply unlocatable thread end, or they require a minute inspection and special manual treatment for any reacquisition of the thread end which is still possible.

In accordance with a further feature of the invention, there is provided an automatic switchover device being connected to the deflector for controlling and resetting the operation thereof.

In accordance with an added feature of the invention the automatic switchover device includes a timer for setting switchover intervals.

In accordance with an additional feature of the invention, there is provided a counter connected to the automatic switchover device for counting the separated cops, and a setting device connected to the automatic switchover device for setting the opening and closing of the deflector according to counting totals or rates set by the counter. When accounting only for the counter total, then recourse must be taken to use empircal values to ensure that after a certain amount of retracted cops, the deflector will be reset over such a period of time. When accounting for the counter rate, however, independence from any empirical values is established. A sharp rise in the counter rate refers directly to the amount of cops, which again or repeatedly circulate without being prepared. Accordingly, upon the occurrance of a rapid rise of the counter rate, a resetting of the deflector occurs earlier. Even a slow rise of the counter rate effects a resetting of the deflector over more extended periods of time.

In accordance with a concomitant feature of the invention, there is provided a chute leading to the other cop separating device, the deflector being disposed in the chute, and the retracting device being in the form of a conveyor belt for transporting separated cops from the first-mentioned separating device to the chute.

Other features which are considered as characteristic for the invention are set forth in the appended claims.

Although the invention is illustrated and described herein as embodied in a cop preparation plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing, which is a fragmentary, diagrammatic, front elevational view, partly broken away, of an embodiment of the invention.

Referring now particularly to the single FIGURE of the drawing, it is seen that reference symbol 1 designates the back wall of a cop preparation plant or machine set 2, which combines a plurality of mutually matched component devices to form a structural unit. Viewed in the cop conveying direction, there is first seen a conveyor belt 3, which includes arms 4. The belt 3 transfers individual cops 5 from a cop separating device 6, which itself is not a component of the cop preparing plant 2. Connected in series with the belt 3 is an elevator 7, including a conveyor belt 8 and two belt rollers 9 and 10. The roller 9 is driven by a central driving motor 11. The belt 8 includes arms 12 disposed in such a way that partitions are formed, in which the cops 5 are deposited by the conveyor belt 3.

The belt 3 is synchronized with a belt 8, namely through the use of a belt roller 13. Another belt roller 14 of the conveyor belt 3 has no drive of its own.

When moving the belt 8 of the elevator 7 in the direction of an arrow 15, the cops drop one after the other into an aligning device 16, which is driven by a motor 17. From the aligner 16, the cops which are aligned with their points up drop into pockets 18 of a horizontal conveyor 23, which consequently guides the coils past a thread blower 19. The blower 19 has three blast nozzles 20, 21, 22 which loosens up a thread end and blows it free of the coil surface.

At the end of the horizontal conveyor 23, the individual coils drop one after the other through a ring suction nozzle 24 into a fall shaft 25. At the upper level of the shaft 25, there is disposed a thread clipper 26, at the center level thereof there is a thread feeler in the form of an electro-optical switch 27 which interacts with a reflector 28 and on the bottom of the shaft 25 there is a suction funnel 29, which serves the function of sucking a thread end 30 into a hollow bobbin tube 31.

From the fall shaft or chute 25, each of the cops are consecutively passed laterally into pockets 32 of a conveyor belt 33 being driven by a belt roller 34, while another belt roller 35 of the belt 33 has no drive of its own. The cops are deposited into boxes 36, 37 by moving a lever 39 of a retainer flap 38 against a stop 40, which releases the cop.

With reference to the drawing, it is equally apparent that the horizontal conveyor 23 has its own driving motor 41, that the thread clipper 26 has an electromagnetic drive 42, that the ring suction nozzle 24 is connected to a suction tube 43 and the suction funnel 29 is connected to a suction tube 44, and that both suction tubes 43, 44 discharge into a collecting pipe 45, which is connected to a non-illustrated vacuum generator.

Adjacent the belt roller 35 there is a swingable or swiveling stop lever 46, which can be controlled by an electromagnetic drive 47. The stop lever 46 can be swiveled into the travel path of levers 39, which opens the retainer flap 38.

Beneath the stop lever 46, a retracting device generally designated with reference numeral 48 is provided for retracting those cops, of which the thread end 30 either has no preset length or is not present at all. This retracting device 48 essentially includes two components, namely a conveyor belt 49 which runs on belt rollers 50, 51 and ridges or arms 48, provided thereon. The roller 51 is driven by driving motor 11.

At the level of the belt roller 51, there is a transfer point 52 to a chute 53. The bottom 54 of the chute 53 carries a deflector 55, which is controlled by an electromagnetic drive 56'. When tilting the deflector 55 upward, as shown in the drawing, a branch or shunt 56 in the bottom 54 is produced in the shape of a bottom opening, which leads to a cop storage bin 57. When closing the deflector 55, however, it completely seals the bottom opening, and the retracted cops can travel through the chute 53 into the cop separating device 6; the chute 53 terminating above the separating device 6. There is furthermore seen an automatic switchover device 58 on the backwall 1, from which electrical lines each form an operative connection, namely the connection 59 fed to the electromagnetic drive 56' of the deflector 55, a connection 60 fed to the electro-optical switch 27, a connection 61 to the electromagnetic drive 42 of thread clipper 26, and a connection 62 to the magnetic drive 47 of stop lever 46, and to a counter 63.

From the drawing it is also apparent that the switchover device 58 has a timer 66 being settable to switchover intervals through setting knobs 64, 65.

The counter 63 counts the separated cops, and is connected to the switchover device 58 by an additional operative connection 67. The automatic switchover device 58 itself has an additional setting device 68 in the form of a setting knob for setting the deflector 55 according to settable counter totals, and a further setting device 69 for setting the deflector 55 according to settable counter rates of the counter 63.

As soon as a cop, such as the cop **5*a*, has dropped into the fall shaft 25, the electro-optical switch 27 ascertains whether or not the thread end 30 is present. If the end 30 is present, then it is cut down to a preset length by the thread clipper 26 and is subsequently sucked into the interior of the bobbin tube 31. If the thread end is not present, however, then a message is sent to the switchover device 58 through the operative connection 60. There the message is temporarily stored. The substandard prepared cop is transferred to the conveyor belt 33. However, it does not travel into one of the boxes 36, 37 because the electromagnetic drive 47 of the stop lever 46 is triggered in sequence with a delay set to match the belt speed setting. The stop lever 46 is swiveled into the travel path of the lever 39 and opens the retainer flap 38 above the conveyor belt 49. Simultaneous with the switching pulse of the electromagnetic drive 47, the counter 63** receives a counting pulse.

The drawing shows a cop **5*b* which has just been separated because it was irregularly prepared, after having dropped onto the conveyor belt 49. Another already separated cop 5*c* is positioned on the chute 53, and is about to drop into the cop storage bin because of the opened deflector 55**.

A rerouting of the separated cop to the cop storage bin 57 takes place because the counter rate of the counter 63 has exceeded a preset value.

The feeding of a separated cop into the cop storage bin 57 is done only during a specified period, which is set by setting knob 64. This is the period of time between the pickup of a cop by the conveyor belt and the deposit of the same cop in one of the boxes 36, 37. When the set period runs out, the deflector 55 is reset, and any subsequently separated cops can therefore slide into the cop separating device 6.

In the above-described case, the deflector 55 is opened upon exceeding a preset counting rate of the counter 63. For setting the counting rate, the amount of cops to be counted is set on the setting device 69, and the period timing this amount is set at the setting knob 65. The deflector 55 then will be raised only if within this set period the preset amount of separated cops is exceeded. With the opening of the deflector 55, the counter 63 is reset to zero. This starts the count again if the deflector 55 has reclosed the branch 56.

Setting of the deflector 55 only according to selectable counter totals is done by setting the setting device 68 to the desired amount of separated cops. Upon reaching this preselected amount, the deflector 55 opens during the timing period set by setting knob 64. The opening of the deflector 55 triggers the reset of the counter 63 to zero. Subsequently the deflector 55 is closed again, whereupon a new counting operation can begin.

To operate the retracting device 48 without any counter at all, it suffices to turn off both setting knobs 68, 69, and to set the closure time of the deflector 55 at the setting knob 65, and the opening time at the setting knob 64.

The invention is not limited to the embodiment shown and described.

Further details of the switchover device 58 may be omitted because they repeat well known electrical switching elements, connections and logic links. The operation as described will be sufficient to teach those skilled in the art the execution of circuit arrangements such as these.

There is claimed:

1. Cop preparation plant for supplying cops with thread ends of a suitable length to be transported to a winding machine, comprising a cycle including first and second cop separating devices, means for removing cops from said first cop separating device, a device disposed down stream of said removing means for locating, drawing off and cutting to length thread ends of a spinning cop, said second cop separating device being disposed down stream of said locating, drawing off and cutting device in travel direction of the cops, for separating spinning cops having thread ends of a substandard length from other spinning cops, and a device disposed down stream of said second separating device for retracting the separated cops into said first cop separating device, each cop being circulated between said first and second cop separating devices until a thread end of a desired length is loosened from the cop and the cop is transported from the cycle to a winding machine.

2. Cop preparation plant according to claim 1, including a cop storage bin, a branch leading from said retracting device to said cop storage bin, and a deflector for selectively deflecting cops to said branch.

3. Cop preparation plant according to claim 2, including an automatic switchover device being connected to said deflector for controlling the operation thereof.

4. Cop preparation plant according to claim 3, wherein said automatic switchover device includes a timer for setting switchover intervals.

5. Cop preparation plant according to claim 3 or 4, including a counter connected to said automatic switchover device for counting the separated cops, and a setting device connected to said automatic switchover device for setting the opening and closing of said deflector according to counting totals set by said counter.

6. Cop preparation plant according to claim 3 or 4, including a counter connected to said automatic switchover device for counting the separated cops, and a setting device connected to said automatic switchover device for setting the opening and closing of said deflector according to counting rates set by said counter.

7. Cop preparation plant according to claim 5, including a chute leading to said first cop separating device, said deflector being disposed in said chute, and said retracting device being in the form of a conveyor belt for transporting separated cops from said second separating device to said chute.

* * * * *